US007999768B2

(12) United States Patent
Kim et al.

(10) Patent No.: US 7,999,768 B2
(45) Date of Patent: Aug. 16, 2011

(54) ORGANIC LIGHT EMITTING DIODE DISPLAY AND DRIVING METHOD THEREOF

(75) Inventors: In Hwam Kim, Seoul (KR); Seung Chan Byun, Incheon (KR); Sang Ho Yu, Seongnam-si (KR); Jin Hyoung Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 990 days.

(21) Appl. No.: 11/770,483

(22) Filed: Jun. 28, 2007

(65) Prior Publication Data

US 2008/0001974 A1 Jan. 3, 2008

(30) Foreign Application Priority Data

Jun. 30, 2006 (KR) ..... 10-2006-0060788

(51) Int. Cl.
*G09G 3/30* (2006.01)
*G09G 3/32* (2006.01)

(52) U.S. Cl. ..... 345/76; 345/82

(58) Field of Classification Search ..... 345/76, 345/82

See application file for complete search history.

(56) References Cited

U.S. PATENT DOCUMENTS

| | | | | |
|---|---|---|---|---|
| 6,373,533 | B1 | 4/2002 | Kawabata et al. | |
| 7,262,727 | B1 * | 8/2007 | Chen et al. | 341/145 |
| 2003/0193457 | A1 * | 10/2003 | Wang et al. | 345/84 |

FOREIGN PATENT DOCUMENTS

| | | | |
|---|---|---|---|
| CN | 1655015 | A | 8/2005 |
| JP | 2002-215083 | A | 7/2002 |
| JP | 2000-513907 | A | 10/2007 |

* cited by examiner

*Primary Examiner* — Amr Awad

*Assistant Examiner* — Jonathan Boyd

(74) *Attorney, Agent, or Firm* — Birch, Stewart, Kolasch & Birch, LLP

(57) ABSTRACT

An organic light emitting diode display for changing a data corresponding to an image property to prevent a deterioration of a life span of an organic light emitting diode device and to improve a picture quality, and a driving method thereof are disclosed. In the method, digital data of an input image of a screen are analyzed to analyze an accumulated density distribution for each gray scale range of an image which to be displayed on the screen. The digital data of the input image is modulated to lower a tilt of a gamma curve corresponding to a pre-set high gray scale range among gamma curves of the input image if data belonged to the high gray scale range turned out to be dominant according to the analyzed result. The digital data of the input image is modulated to raise a tilt of a gamma curve corresponding to a specific gray scale range among gamma curves of the input image if data belonged to the specific gray scale is determined as a dominant of the digital data of the input image according to the analyzed result. And the modulated digital data is converted into an analog signal.

12 Claims, 11 Drawing Sheets

ORGANIC LIGHT EMITTING DIODE DISPLAY AND DRIVING METHOD THEREOF

This application claims the benefit of Korean Patent Application No. P2006-060788 in Korea on Jun. 30, 2006, which is hereby incorporated by reference.

BACKGROUND OF THE INVENTION

1. Field of the Invention

The present invention relates to an organic light emitting diode display and a driving method thereof, and more particularly to an organic light emitting diode display that is adaptive for changing a data corresponding to an image property to prevent a reduction of a life span of an organic light emitting diode device and to improve a picture quality, and a driving method thereof.

2. Description of the Related Art

Recently, there have been many developments in flat panel display devices capable of reducing weight and bulk which are disadvantages of a cathode ray tube. Such flat panel display devices include a liquid crystal display (hereinafter, referred to as "LCD"), a field emission display (hereinafter, referred to as "FED"), a plasma display panel (hereinafter, referred to as "PDP"), and an electro-luminescence display device (hereinafter, referred to as "EL"), etc.

The PDP has an advantage of light weight and thin profile, and has been highlighted as a display device that is adaptive for making a large-dimension screen owing to its characteristics of a simple structure and a simple manufacturing process. However, the PDP has a disadvantage of a low luminous efficiency, a low brightness, and high power consumption. On the other hand, since an active matrix LCD to which a thin film transistor (hereinafter, referred to as "TFT") as a switching terminal is applied, uses a semiconductor process, it is difficult to make a large-dimension screen. The active matrix LCD has a disadvantage in that power consumption is increased by a backlight unit.

On the other hand, the EL display device is largely classified into an inorganic light emitting diode display and an organic light emitting diode display depending upon a material of a light emitting layer and is a self-luminous device that is capable of light-emitting for itself. Furthermore, the EL display device has an advantage of a fast response speed, a high luminous efficiency, a high brightness, and a wide viewing angle. The inorganic EL display has high power consumption and cannot obtain a high brightness compared to the organic EL display device. Furthermore, the inorganic light emitting diode display cannot emit a variety of colors such as an R color, a G color, and a B color. On the other hand, the organic light emitting diode display is driven at a low DC voltage of dozens of volts, has a fast response speed, and can obtain a high brightness. As a result, the organic light emitting diode display can emit a variety of colors such as an R color, a G color, and a B color, and is adaptive for a post-generation flat panel display.

The organic light emitting diode display has an organic light emitting diode device as shown in FIG. 1. If a voltage is applied between an anode 100 of the organic light emitting diode device and a cathode 70 of the organic light emitting diode device, an electron generated from the cathode 70 moves toward an organic light emitting layer 78*c* via an electron injection layer 78*a* and an electron transport layer 78*b*. Further, a hole generated from the anode 100 moves forward the organic light emitting layer 78*c* via a hole injection layer 78*e* and a hole transport layer 78*d*. Thus, an electron and a hole are collided with each other to be re-combined to generate a light in the organic light emitting layer 78*c*. Herein, the electron and the hole are supplied from the electron transport layer 78*b* and the hole transport layer 78*d*, respectively. As a result, the light is emitted to the exterior via the anode 100 to display an image.

FIG. 2 is a block diagram schematically showing the organic light emitting diode display of the related art. Referring to FIG. 2, the organic light emitting diode display of the related art includes an OLED panel 20, a gate driving circuit 22, a data driving circuit 24, a gamma voltage generator 26, and a timing controller 27. Herein, the OLED panel 20 includes pixels 28 arranged at an area where is defined by a crossing of a gate line GL and a data line DL. The gate driving circuit 22 drives the gate lines GL of the OLED panel 20. The data driving circuit 24 drives the data lines DL of the OLED panel 20. The gamma voltage generator 26 supplies a plurality of gamma voltages to the data driving circuit 24. The timing controller 27 controls the data driving circuit 24 and the gate driving circuit 22.

The pixels 28 are arranged in a matrix type at the OLED panel 20. Further, a supply pad 10 and a ground pad 12 are disposed at the OLED panel 20. Herein, the supply pad 10 is supplied with a high-level potential voltage from a high-level potential voltage source VDD. The ground pad 12 is supplied with a ground voltage from a ground voltage source GND. In this case, the high-level potential voltage and the ground voltage are supplied to each pixel 28.

The gate driving circuit 22 supplies a gate signal to the gate lines GL to sequentially drive the gate lines GL.

The gamma voltage generator 26 supplies a plurality of analog gamma voltage to the data driving circuit 24. Herein, the gamma voltage generator 26 generates a positive polarity gamma voltage and a negative polarity gamma voltage which have a predetermined tilttilt corresponding to a characteristics of the OLED panel 20.

The timing controller 27 generates a data control signal which controls the data driving circuit 24 and a gate control signal which controls the gate driving circuit 22 using a plurality of synchronizing signals. A data control signal generated from the timing controller 27 is supplied to the data driving circuit 24 to control the data driving circuit 24. A gate control signal generated from the timing controller 27 is supplied to the gate driving circuit 22 to control the gate driving circuit 22. Furthermore, the timing controller 27 rearranges a digital data which is supplied from a scaler in accordance with a resolution of the OLED panel 20 to supply it to the data driving circuit 24.

When a gate signal is supplied to the gate line GL, each pixel 28 is supplied with a data signal from the data line DL to generate a light corresponding to the data signal. To this end, each pixel 28 includes an organic light emitting diode device OLED and a cell driving circuit 30 as shown in FIG. 3. Herein, the organic light emitting diode device OLED has a cathode which is connected to the ground voltage source GND. The cell driving circuit 30 is connected to the gate line GL, the data line DL, and the high-level potential voltage source VDD and is connected to an anode of the organic light emitting diode device OLED to drive the organic light emitting diode device OLED. The cell driving circuit 30 includes a switching TFT T1, a driving TFT T2, and a capacitor C. When a gate signal is supplied to the gate line GL, the switching TFT T1 is turned-on to supply a data signal which is supplied to the data line DL to a node N. A data signal which is supplied to the node N is charged into the capacitor C and is supplied to a gate terminal of the driving TFT T2. The driving TFT T2 controls a current amount I which is supplied to the organic light emitting diode device OLED from the high-level potential voltage source VDD in response to a data signal with which the gate terminal is supplied to adjust a light emitting amount of the organic light emitting diode device OLED. Since a data signal is discharged from the capacitor C although the switching TFT T1 is turned-off, the driving TFT T2 supplies a current I from the high-level potential voltage source VDD to the organic light emitting diode device OLED to allow the organic light emitting diode device OLED to keep a light emitting until a data signal of the next frame is supplied. Herein, an actual cell driving circuit 30 may be set in a variety of structures other than the above-mentioned structure.

The data driving circuit 24 converts a data with which thereof is supplied into an analog gamma voltage (data signal) corresponding to a gray scale value in response to a data control signal from the timing controller 27, and supplies the data signal to the data lines DL. Herein, the data driving circuit 24 generates a data signal using any one analog gamma voltage corresponding to a data among a plurality of analog gamma voltages which are supplied from the gamma voltage generator 26. More specifically, the data driving circuit 24 selects any one voltage value among the analog gamma voltages which are supplied from the gamma voltage generator 26 corresponding to a gray scale of a data, and supplies the selected voltage signal to the data lines DL as a data signal. As a result, an image having brightness corresponding to a gray scale of a data is displayed at the OLED panel 20.

On the other hand, since a forward current, that is, a current which flows from an anode to a cathode is always applied to the organic light emitting diode device OLED, a degradation of the organic light emitting layer 78*c* is aggravated by a stress which is generated by an applying current as a driving time is increased. If the degradation of the organic light emitting layer 78*c* is aggravated, a life span of the organic light emitting diode device OLED is reduced. Specifically, since brightness of a display image is in proportion to an amount of a current which is applied to the organic light emitting diode device OLED, the above-mentioned problem is remarkable at a high brightness image having data of a high gray scale range.

On the other hand, in the organic light emitting diode display of the related art, the switching TFT T1 and the driving TFT T2 include a semiconductor layer having a polysilicon p-Si for good electric field effect mobility. The p-Si thin film transistor is formed by a low temperature poly si LTPS through a laser annealing using an amorphous silicon a-Si. If the LTPS is used, the manufacturing cost is reduced. However, a tit stain is generated at a display image by a laser scan. Moreover, since such a stain is remarkably shown at a low brightness image having data of a low gray scale range, the organic light emitting diode display of the related art has an disadvantage in that an uniformity of an image is deteriorated in the low gray scale range.

SUMMARY OF THE INVENTION

Accordingly, it is an object of the present invention to provide an organic light emitting diode display that is adaptive for modulating an input digital data in a high-level brightness image having data of a high gray scale range to decrease brightness of an image, thereby preventing a deterioration of a life span of an organic light emitting diode device, and a driving method thereof.

Accordingly, it is another object of the present invention to provide an organic light emitting diode display that is adaptive for modulating an input digital data in a low brightness image having data of a low gray scale range to increase brightness of an image, thereby preventing a deterioration of a uniformity of an image at the low gray scale range, and a driving method thereof.

In order to achieve these and other objects of the invention, a method of driving an organic light emitting diode display according to an embodiment of the present invention comprises analyzing a digital data corresponding to an input image of a screen to analyze an accumulated density distribution for each gray scale range of the image which to be displayed on the screen; modulating the digital data of the input image to lower a tilt of a gamma curve corresponding to a pre-set high gray scale range among gamma curves of the input image if data belonged to the high gray scale range is determined as a dominant of the digital data of the input image according to the analyzed result; modulating the digital data of the input image to raise a tilt of a gamma curve corresponding to a specific gray scale range among gamma curves of the input image if data belonged to the specific gray scale range is determined as a dominant of the digital data of the input image as the analyzed result, wherein the specific gray scale range is set lower than the high gray scale range; and converting the modulated digital data of the input image into an analog signal.

A gamma curve of entire gray scale ranges corresponding to the digital data of the input image is determined depending upon a reference tilt which is differently set for each gray scale range.

The method of driving the organic light emitting diode display according to claim 2, wherein the tilt of the gamma curve corresponding to the high gray scale range is adjusted to a tilt lower than the reference tilt if data belonged to the high gray scale range is determined as a dominant of the digital data of the input data.

The tilt of the gamma curve corresponding to the high gray scale range is adjusted to a tilt lower than the reference tilt if data belonged to the high gray scale range is determined as a dominant of the digital data of the input data.

The tilt of the gamma curve corresponding to the high gray scale range is fixed to the reference tilt if data belonged to the high gray scale range is less than data belonged to the other gray scale ranges.

In the step of modulating the data, comprising, connecting gamma curves for each gray scale range each other so that an end point of a gamma curve of the previous gray scale range is connected to a start point of a gamma curve of a next gray scale range.

The tilt of the gamma curve corresponding to the specific gray scale range is adjusted to a tilt higher than the reference tilt if data belonged to the specific gray scale range is determined as a dominant of the digital data of the input.

The tilt of the gamma curve corresponding to the specific gray scale range is fixed to the reference tilt if data belonged to the specific gray scale range is less than data belonged to to other gray scale ranges.

A method of driving an organic light emitting diode display according to an embodiment of the present invention comprises analyzing digital data corresponding to an input image of a screen to analyze an accumulated density distribution for each gray scale range of an image to be displayed on the screen; modulating the digital data of the input image to lower a tilt of a gamma curve corresponding to a pre-set high gray scale range among gamma curves of the input image if data belonged to the high gray scale range is determined as a dominant of the digital data of the input data as the analyzed result; and converting the modulated digital data of the input image into an analog signal.

A method of driving an organic light emitting diode display according to an embodiment of the present invention comprises analyzing a digital data corresponding to an input image of a screen to analyze an accumulated density distribution for each gray scale range of an image to be displayed on the screen; modulating a digital data of the input image to raise a tilt of a gamma curve corresponding to a specific gray scale range among gamma curves of the input image if data belonged to a gray scale range is determined as a dominant of the digital data of the input image according to the analyzed result, wherein the specific gray scale range is set lower than the high gray scale range; and converting the modulated digital data of the input image into an analog signal.

Furthermore, an organic light emitting diode display according to an embodiment of the present invention comprises an organic light emitting diode display panel; an image analyzer analyzing a digital data of an input image of a screen to analyze an accumulated density distribution for each gray scale range of an image to be displayed on the screen; a data modulator modulating the digital data of the input image to lower a tilt of a gamma curve corresponding to a pre-set high gray scale range among gamma curves of the input image if data belonged to the high gray scale range is determined as a dominant of the digital data of the input data according to the analyzed result, and modulating the digital data of the input image to raise a tilt of a gamma curve corresponding to a specific gray scale range among gamma curves of the input image if data belonged to the specific gray scale range is determined as a dominant of the digital data of the input image according to the analyzed result, wherein the specific gray scale range is set lower than the high gray scale range; and a driver converting the modulated digital data into an analog signal and outputting the analog signal to the organic light emitting diode display panel.

An organic light emitting diode display according to an embodiment of the present invention comprises an organic light emitting diode display panel; an image analyzer analyzing a digital data of an input image of a screen to analyze an accumulated density distribution for each gray scale range of an image to be displayed on the screen; a data modulator modulating the digital data of the input image to lower a tilt of a gamma curve corresponding to a pre-set high gray scale range among gamma curves of the input image if data belonged to the high gray scale is determined as a dominant of the digital data of the input image according to the analyzed result; and a driver converting the modulated digital data into an analog signal and outputting the analog signal to the organic light emitting diode display panel.

An organic light emitting diode display according to an embodiment of the present invention comprises an organic light emitting diode display panel; an image analyzer analyzing a digital data of an input image of a screen to analyze an accumulated density distribution for each gray scale range of an image to be displayed on the screen; a data modulator modulating the digital data of the input image to raise a tilt of a gamma curve corresponding to a specific gray scale range among gamma curves of the input image if data belonged to the specific gray scale range is determined as a dominant of the digital data of the input image according to the analyzed result, wherein the specific gray scale range is set as a predetermined interval between the high gray scale range and the low gray scale range; and a driver converting the modulated digital data into an analog signal and outputting the analog signal to the organic light emitting diode display panel.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to FIG. 4 to FIG. 11.

Figure 1:
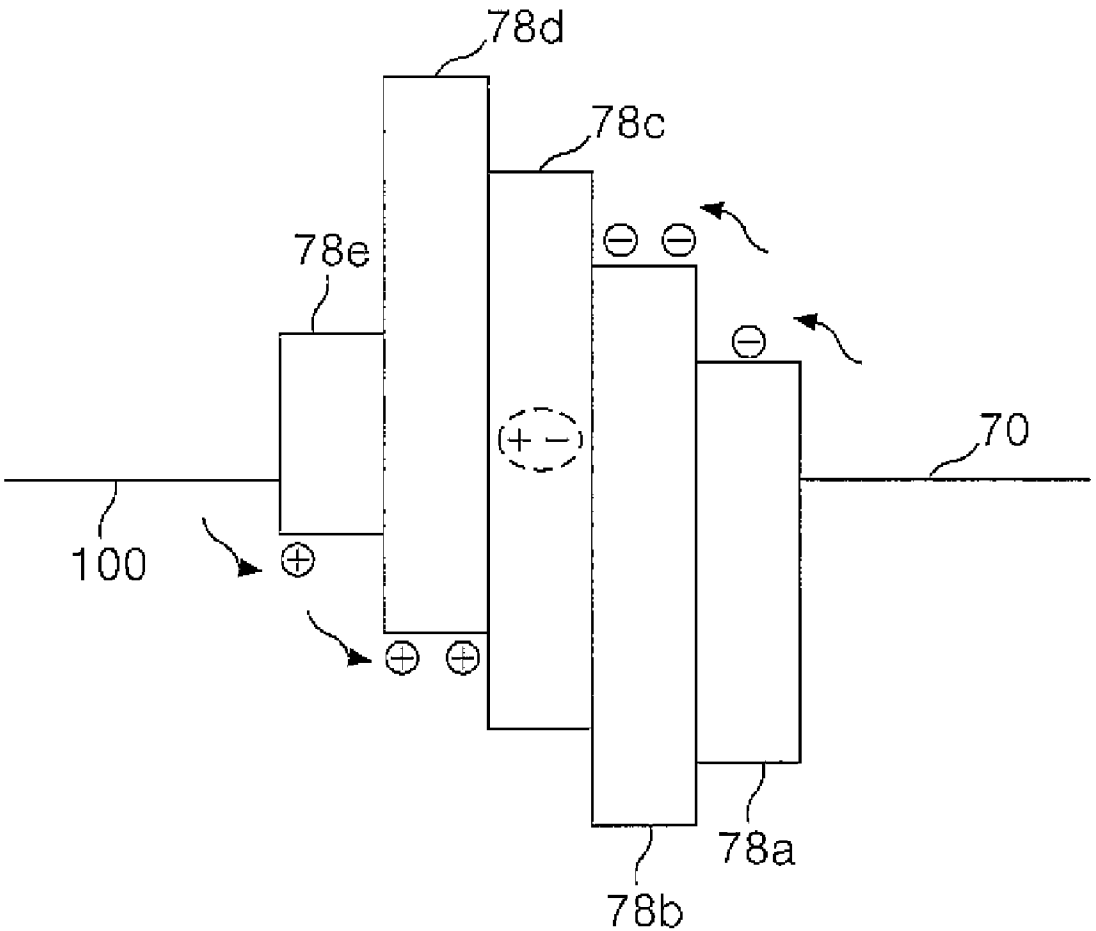
FIG. 1 RELATED ART
FIG. 1 is a diagram explaining a light emitting principle of an organic light emitting diode display of the related art.
Figure 2:
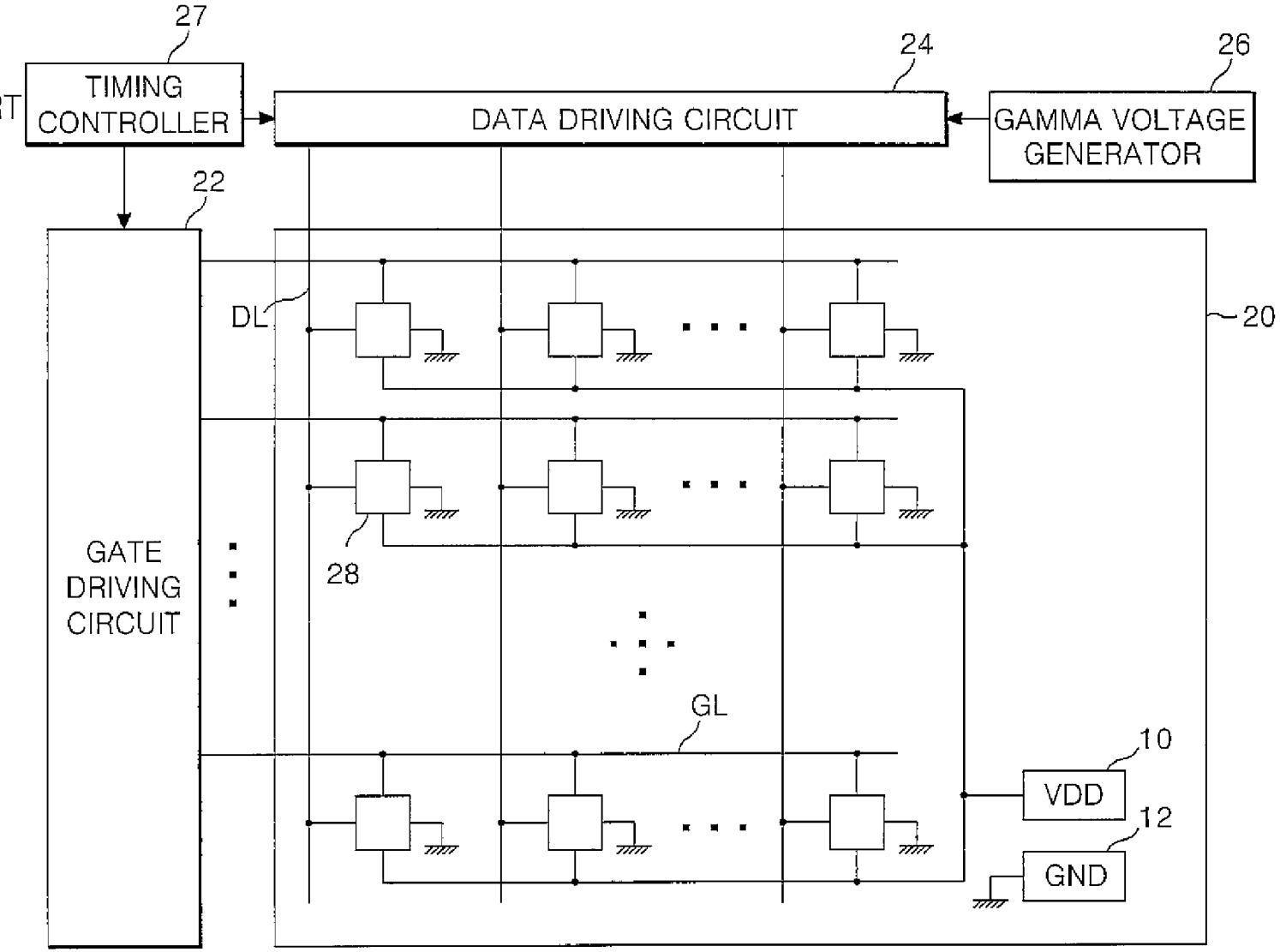
FIG. 2 RELATED ART
FIG. 2 is a block diagram schematically showing an organic light emitting diode display of the related art.
Figure 3:
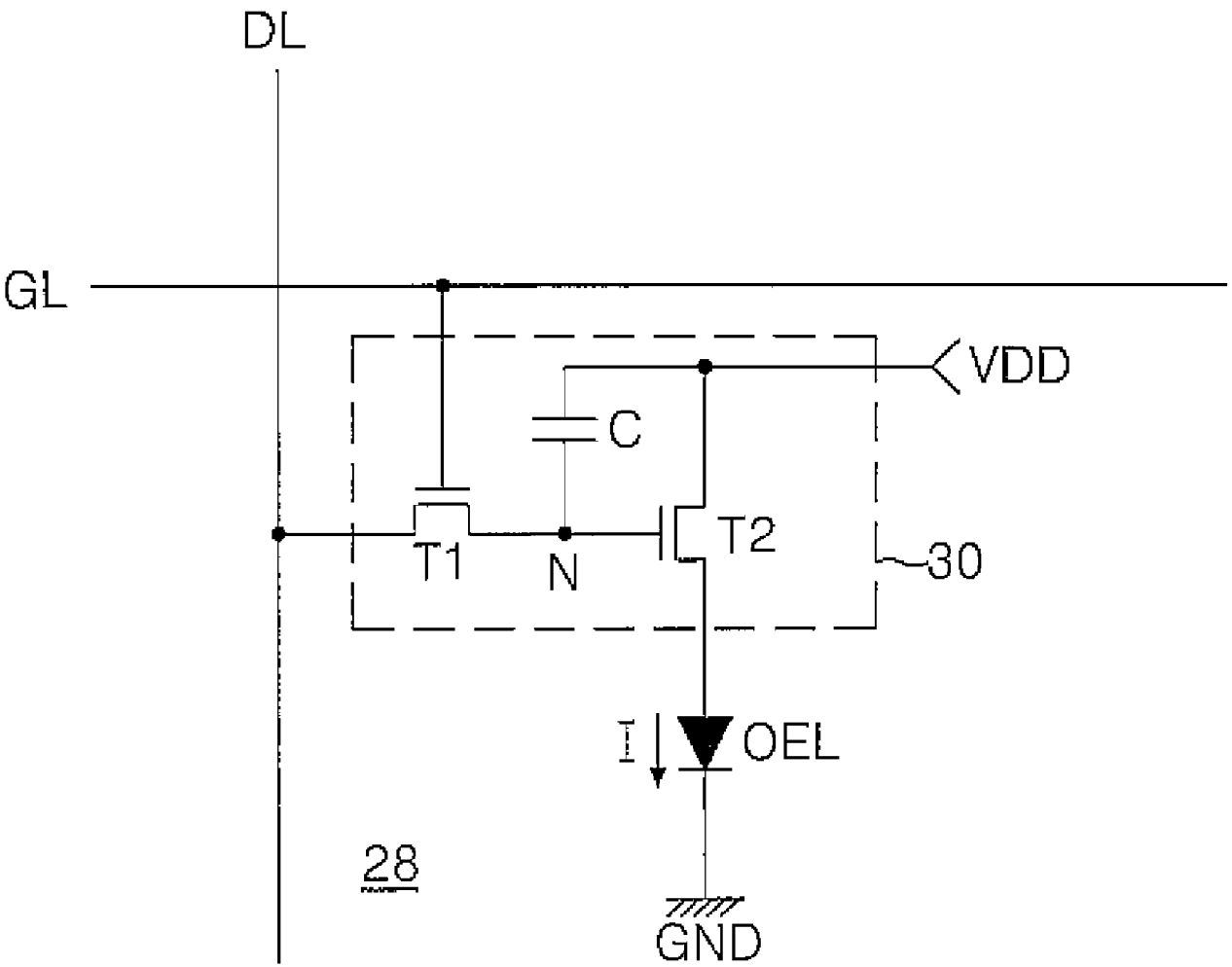
FIG. 3 RELATED ART
FIG. 3 is a circuit diagram showing in detail the pixel in FIG. 2.
Figure 4:
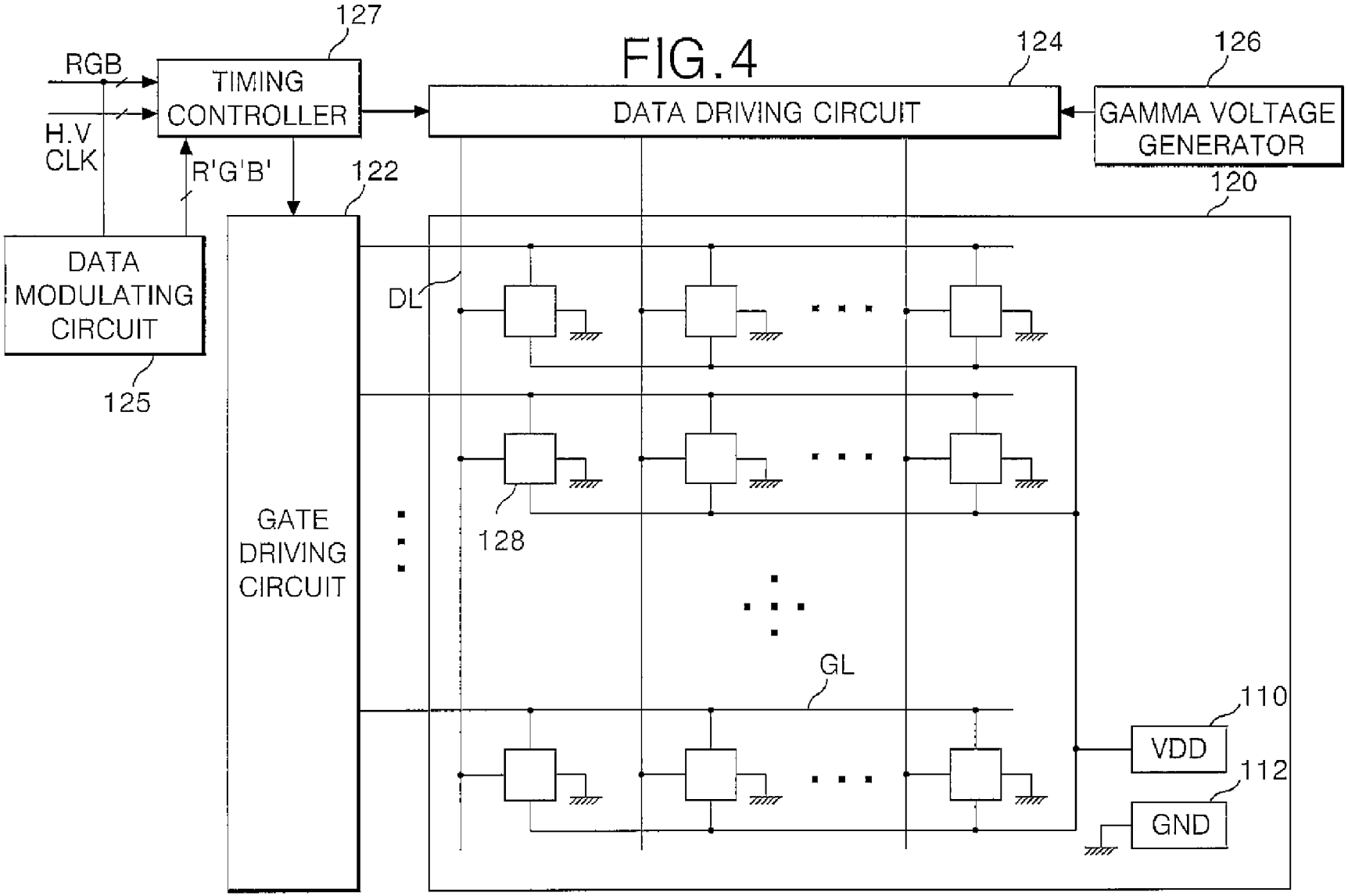
FIG. 4 is a block diagram showing an organic light emitting diode display according to an embodiment of the present invention.

FIG. 4 is a block diagram showing an organic light emitting diode display according to an embodiment of the present invention.

Referring to FIG. 4, an organic light emitting diode display according to an embodiment of the present invention includes an OLED panel 120, a gate driving circuit 122, a data driving circuit 124, a gamma voltage generator 126, a data modulating circuit 125, and a timing controller 127. Herein, the OLED panel 120 includes pixels 128 arranged at an area where is defined by a crossing of a gate line CL and a data line DL. The gate driving circuit 122 drives the gate lines GL of the OLED panel 120. The data driving circuit 124 drives the data lines DL of the OLED panel 120. The gamma voltage generator 126 supplies a plurality of gamma voltages to the data driving circuit 124. The data modulating circuit 125 analyzes an accumulated density distribution for each predetermined gray scale range regarding digital data of an input image of one screen, and modulates a digital data of an input image to allow a gamma curve tilt within a predetermined gray scale range to be changed on the basis of the analyzed result. The timing controller 27 supplies the modulated digital data to the data driving circuit 124, and controls the data driving circuit 124 and the gate driving circuit 122.

The pixels 128 are arranged in a matrix type at the OLED panel 120. Further, a supply pad 110 and a ground pad 112 are disposed at the OLED panel 120. Herein, the supply pad 110 is supplied with a high-level potential voltage from a high-level potential voltage source VDD. The ground pad 112 is supplied with a ground voltage from a ground voltage source GND. In this case, the high-level potential voltage and the ground voltage are supplied to each pixel 128.

The gate driving circuit 122 is comprised of a shift register, a level shift, and an output buffer, etc. Herein, the shift register sequentially generates a scanning signal in response to a gate control signal GDC from the timing controller 127. The level shift shifts a swing width of a scanning signal into a level that is adaptive for a driving of the pixels 128. The gate driving circuit 122 supplies a scanning signal to the gate lines GL to turn-on switching TFTs which are connected to the gate lines CL, thereby selecting the pixels 128 of one horizontal line to be supplied with an analog gamma voltage.

The data driving circuit 124 is comprised of a shift register, a register, a latch, a digital/analog converter, a multiplexer, and an output buffer, etc. Herein, the register temporarily stores digital video data R'G'B' which are modulated from the timing controller 127. The latch stores data by one line in response to a clock signal from the shift register and, at the same time outputs the stored one line data. The digital/analog converter selects an analog positive polarity/negative polarity gamma voltage corresponding to a digital data value from the latch. The multiplexer selects the data line DL to which the analog positive polarity/negative polarity gamma voltage is supplied. The output buffer is connected between the multiplexer and the data line DL. The data driving circuit 124 is inputted with the modulated digital video data R'G'B', and supplies the data R'G'B' to the data lines DL of the OLED panel 120 to be synchronized with a scanning signal under a control of the timing controller 127. As a result, an image having brightness corresponding to a gray scale of the modulated data is displayed at the OLED panel 120.

The gamma voltage generator 126 supplies a plurality of analog gamma voltage to the data driving circuit 124. Herein, the gamma voltage generator 126 generates a positive polarity gamma voltage and a negative polarity gamma voltage which have a predetermined tilt corresponding to a characteristics of the OLED panel 120.

The data modulating circuit 125 analyzes a histogram for each screen, that is, an accumulated density distribution of a pixel for each predetermined gray scale range, and modulates a digital data of an input image to allow a gamma curve tilt within a predetermined gray scale range to be changed on the basis of the analyzed result. Herein, a gamma curve of the entire gray scale ranges regarding digital data of the input image is determined depending upon a reference tilt which is differently set for each gray scale range. The data modulating circuit 125 modulates a digital data of an input image to allow a tilt of a gamma curve of high gray scale range to be lowered than a reference tilt in the case where data of an input image are dominantly shown within the pre-set high gray scale range. The organic light emitting diode display according to the present invention partially reduces brightness of a high-level brightness image using the data modulating circuit 125 to prevent a deterioration of a life span of the organic light emitting diode device. Furthermore, the data modulating circuit 125 modulates a digital data of an input image to allow a tilt of a gamma curve of the specific gray scale range to be heightened than a reference tilt in the case where data of an input image are dominantly shown within the pre-set specific gray scale (low gray scale) range. The organic light emitting diode display according to the present invention partially increases brightness of a low brightness image using the data modulating circuit 125 to prevent a deterioration of uniformity of an image in a low gray scale range. On the other hand, the data modulating circuit 125 modulates a digital data of an input image to allow a tilt of a gamma curve of the high gray scale range and the specific gray scale range to be fixed to a reference tilt in the case where data of an input image are not dominantly shown within the pre-set high gray scale range and the pre-set specific gray scale range. The data modulating circuit 125 can be mounted within the timing controller 127.

The timing controller 127 re-arranges the modulated digital video data R'G'B' which are supplied from the data modulating circuit 125 in accordance with a resolution of the OLED panel 120 to supply it to the data driving circuit 124. Furthermore, the timing controller 127 generates a data control signal which controls the data driving circuit 124 and a gate control signal which controls the gate driving circuit 122 using a plurality of synchronizing signals. A data control signal generated from the timing controller 127 is supplied to the data driving circuit 124 to control the data driving circuit 124. A gate control signal generated from the timing controller 127 is supplied to the gate driving circuit 122 to control the gate driving circuit 122.

Figure 5:
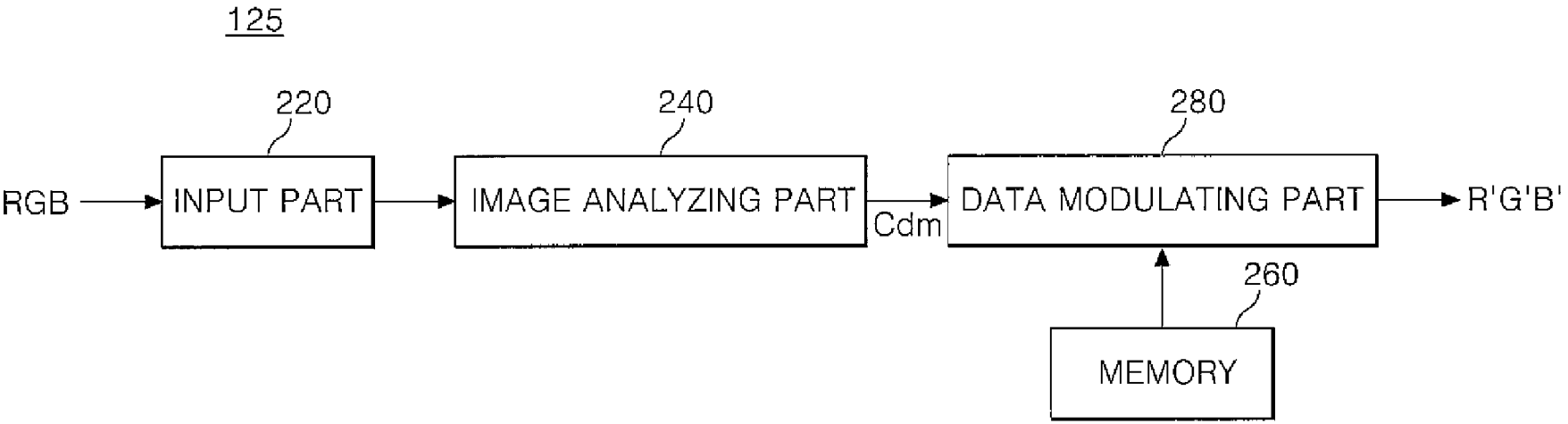
FIG. 5 is a diagram showing in detail a configuration of the data modulating circuit in FIG. 4.

FIG. 5 is a diagram showing in detail a configuration of the data modulating circuit.

Referring to FIG. 5 the data modulating circuit 125 includes an input part 220, an image analyzing part 240, a memory 260, and a data modulating part 280.

The input part 220 is inputted with digital video data RGB and a synchronizing signal from the exterior. The input part 220 supplies the inputted digital video data RGB to the image analyzing part 240.

Figure 6:
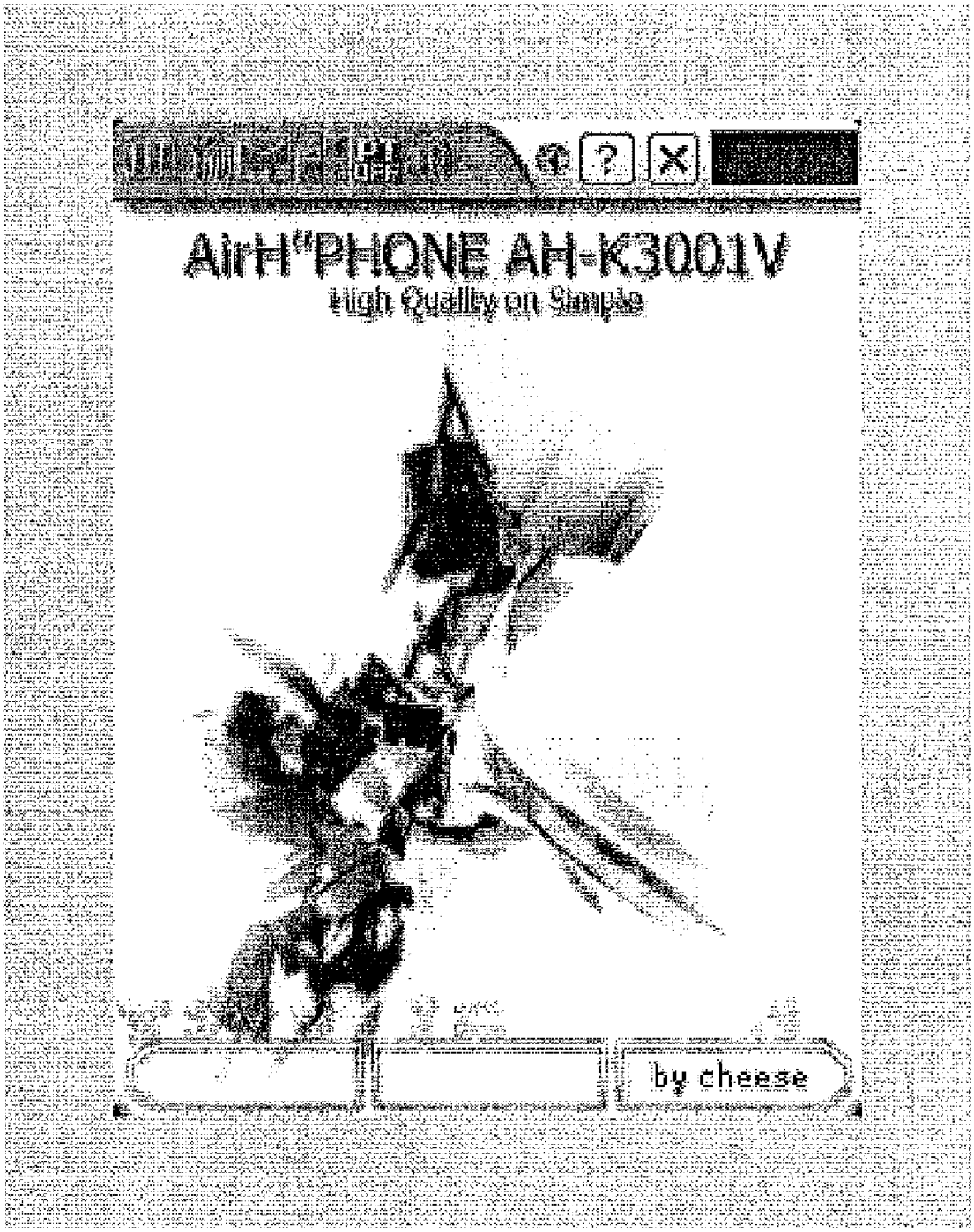
FIG. 6 is a diagram showing an example of a case that an input image is a bright image having high-level brightness.
Figure 7:
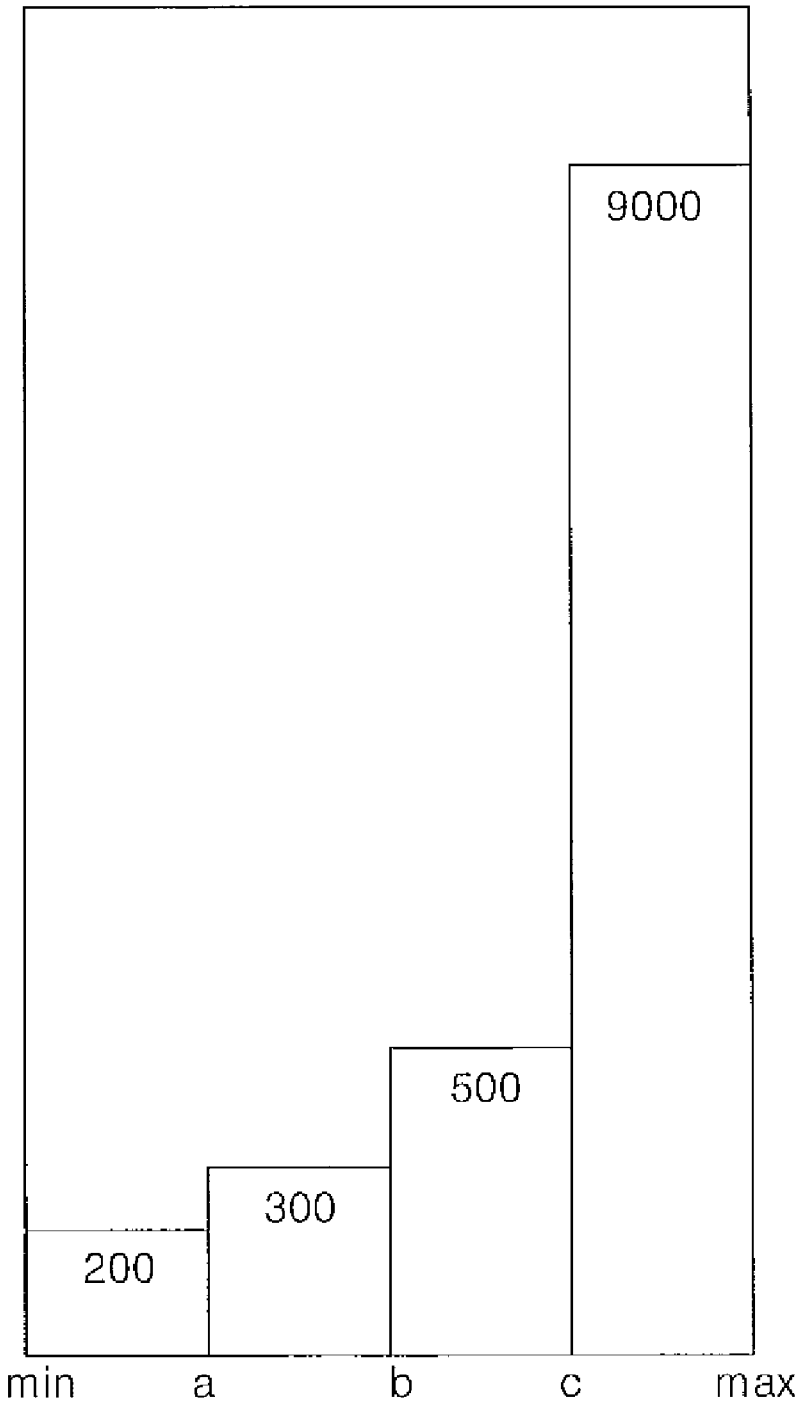
FIG. 7 is a diagram showing an accumulated density distribution of a pixel for each gray scale range regarding FIG. 6.
Figure 9:
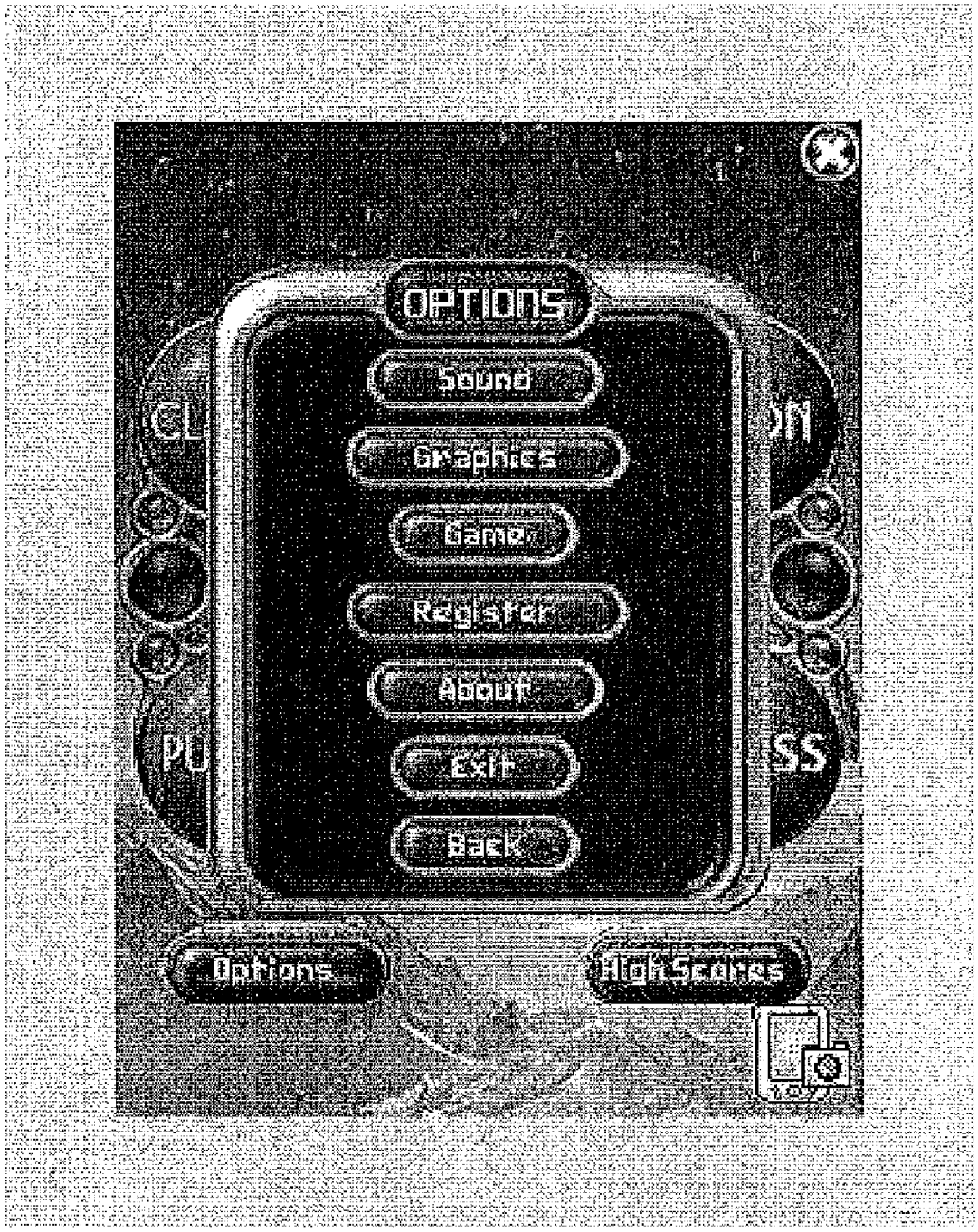
FIG. 9 is a diagram showing an example of a case that an input image is a dark image having low brightness.
Figure 10:
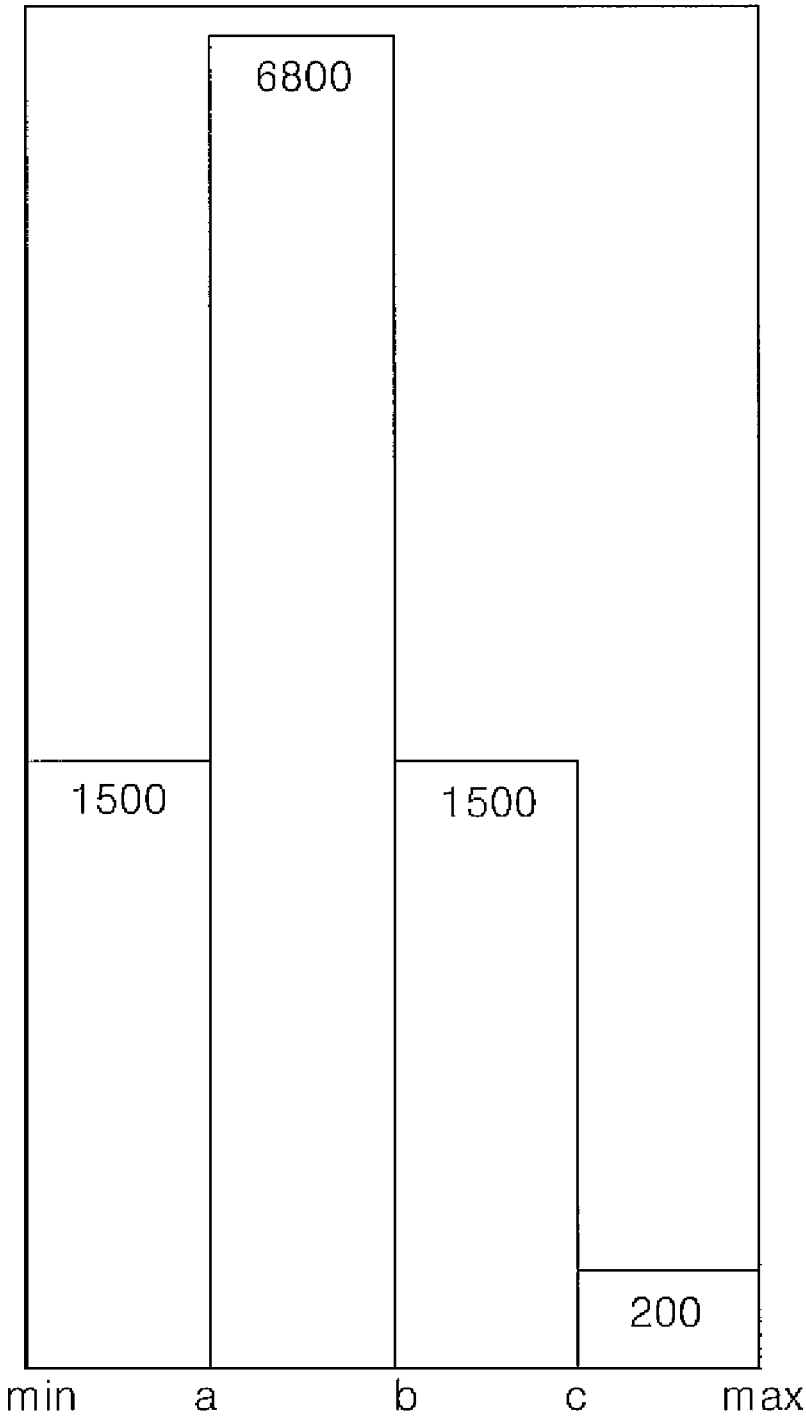
FIG. 10 is a diagram showing an accumulated density distribution of a pixel for each gray scale range regarding FIG. 9.

The image analyzing part 240 analyzes an image property of digital video data RGB which are supplied from the input part 220, and supplies a control signal corresponding to the analyzed image property to the data modulating part 280. A variety of methods can be used for analyzing an image property of data in the image analyzing part 240. In other words, the image analyzing part 240 arranges data by one frame to be corresponded to a plurality of gray scale ranges to generate a histogram. Herein, the gray scale ranges can diversely divided in accordance with an OLED characteristics. In the embodiment of the present invention, for the sake of explanation, the gray scale ranges will be divided into a minimum gray scale range (min to a) a low gray scale range (a to b), an intermediate gray scale range (b to c), and a high gray scale range (c to max) as shown in FIG. 5. For example, an accumulated density distribution of a pixel for each gray scale range is high at the high gray scale range (c to max) as shown in FIG. 7 in the case where an input image is a bright image of high-level brightness as shown in FIG. 6. Furthermore, an accumulated density distribution of a pixel for each gray scale range is high at the low gray scale range (a to b) as shown in FIG. 10 in the case where an input image is a dark image of low-level brightness as shown in FIG. 9. If an accumulated density of a pixel regarding the high gray scale range (c to max) and the low gray scale range (a to b) exceeds over the pre-set reference value, the image analyzing part 240 supplies a data modulating control signal Cdm to the data modulating part 280. Herein, the reference value can be determined by an experiment.

The data modulating part 280 modulates a gray scale value of the digital video data which are supplied from the input part 220 using a look-up table LUT which is stored at the memory 260 in response to the data modulating control signal Cdm from the image analyzing part 240. Output data R'G'B' are mapped to the look-up table LUT. Herein, the output data R'G'B' have a second gray scale value corresponding to input data RGB which have a first gray scale value. In this way, the data modulating part 280 modulates the input data RGB to allow a gray scale value of the output data R'G'B' to be further lowered than a gray scale value of the input data RGB when an accumulated density of a pixel regarding the high gray scale range (c to max) exceeds over the pre-set reference value. Furthermore, the data modulating part 280 modulates the input data RGB to allow a gray scale value of the output data R'G'B' to be further heightened than a gray scale value of the input data RGB when an accumulated density of a pixel regarding the low gray scale range (a to b) exceeds over the pre-set reference value.

If the data modulating control signal Cdm is supplied from the image analyzing part 240 to the data modulating part 280, the memory 260 supplies a gray scale value of the output data R'G'B' regarding a gray scale value of the input data RGB at the low gray scale range (a to b) and the high gray scale range (c to max) to the data modulating part 280. A plurality of look-up tables (LUT1, . . . , LUTi) are stored at the memory 260. Accordingly, the memory 260 to which a control signal is supplied from the image analyzing part 240 supplies look-up table LUT information corresponding to a control signal to the data modulating part 280. The look-up table LUT is experimentally determined in order to realize an optimum image and prevent a deterioration of a life span of the organic light emitting diode device OLED corresponding to a variety of image properties. For example, the look-up table LUT that improves an input versus output ratio at the low gray scale range (a to b) corresponding to data of a dark image property is stored at the memory 260. Furthermore, the look-up table LUT that lowers an input versus output ratio at the high gray scale range (c to max) corresponding to data of a bright image property to prevent a deterioration of a life span of the organic light emitting diode device OLED is stored at the memory 260. The memory 260 may be disposed at the exterior of the timing controller 127, and may be disposed at the interior of the timing controller 127.

Figure 8:
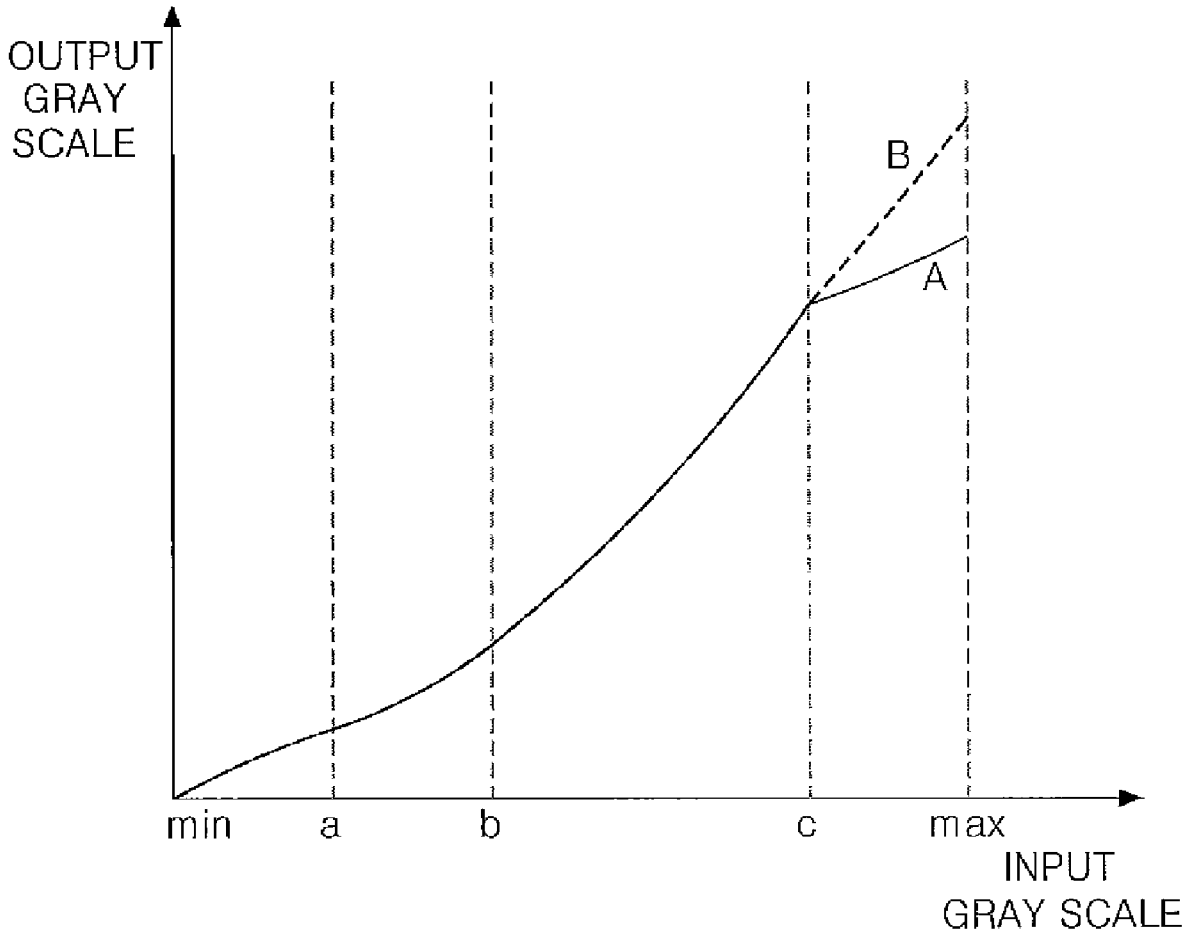
FIG. 8 is a diagram showing that a tilt of an output gamma curve is changed at a high gray scale range by modulating a high gray scale input data.

FIG. 6 is a diagram showing an example of a case that an input image is a bright image having high-level brightness, FIG. 7 is a diagram showing an accumulated density distribution of a pixel for each gray scale range regarding FIG. 6, and FIG. 8 is a diagram showing that a tilt of an output gamma curve is changed at the high gray scale range (c to max) by modulating a high gray scale input data.

A method of modulating a digital data of an input image at the high gray scale range (c to max) according to the embodiment of the present invention will be described with reference to FIG. 6 to FIG. 8 as follows. First, if a resolution of an OLED panel that an image of 256 gray scales is display by an input data having 8 bits is 100×100, and a histogram is divided into 4 number of gray scale areas, the number of whole pixel data of one screen is 10000. It assumes that the number of pixel data which are cumulated for each gray scale area of a histogram regarding one frame data of an image to be inputted to the OLED panel is the same as a graph in FIG. 7. An accumulated density distribution of a pixel for each gray scale range is high at the high gray scale range (c to max) as shown in FIG. 7 in the case where an input image is a bright image of high-level brightness as shown in FIG. 6. In other words, FIG. 7 shows that 200 number of pixel data exist at the minimum gray scale (min to a) area, 300 number of pixel data exist at the low gray scale (a to b) area, 500 number of pixel data exist at the intermediate gray scale (b to c) area, and 9000 number of pixel data exist at the high gray scale (c to max) area. Accordingly, The image analyzing part 240 judges that an accumulated density of a pixel regarding the high gray scale range (c to max) exceeds over the pre-set reference value X1. And The image analyzing part 240 supplies the data modulating control signal Cdm to the data modulating part 280 The reference value X1 is a value which is defined in the case where the cumulated pixel number at the high gray scale (c to max) area is further increased as much as a predetermined value k1 than a sum Y1 of the cumulated pixel number at the area (min to c) other than thereof. Herein, since the predetermined value k1 is changeable, the reference value X1 may be set as a few numbers depending upon a characteristics of the OLED panel.

In order to prevent a deterioration of a life span of the organic light emitting diode device OLED, the data modulating part 280 lowers a tilt of an output gamma curve to narrow down a range of expressing a gray scale at the high gray scale (c to max) area in response to the data modulating control signal Cdm as shown in FIG. 8. A tilt of an output gamma curve is determined between the pre-set minimum critical value A and the pre-set reference value B at the high gray scale (c to max) area. In other words, a tilt of an output gamma curve is determined to the minimum critical value A when an accumulated density of a pixel regarding the high gray scale range (c to max) is relatively the highest. A tilt of an output gamma curve is determined to the reference value B when an accumulated density of a pixel regarding the high gray scale range (c to max) is relatively the lowest. In this way, a plurality of look-up tables LUT are stored at the memory 260 in order to change a tilt of an output gamma curve. Herein, the plurality of look-up tables LUT lower an input versus output ratio at the high gray scale range (c to max) corresponding to a data of bright image property. On the other hand, output gamma curves of an area (min to c) other than the high gray scale range (c to max) are determined to the pre-set reference values.

Figure 11:
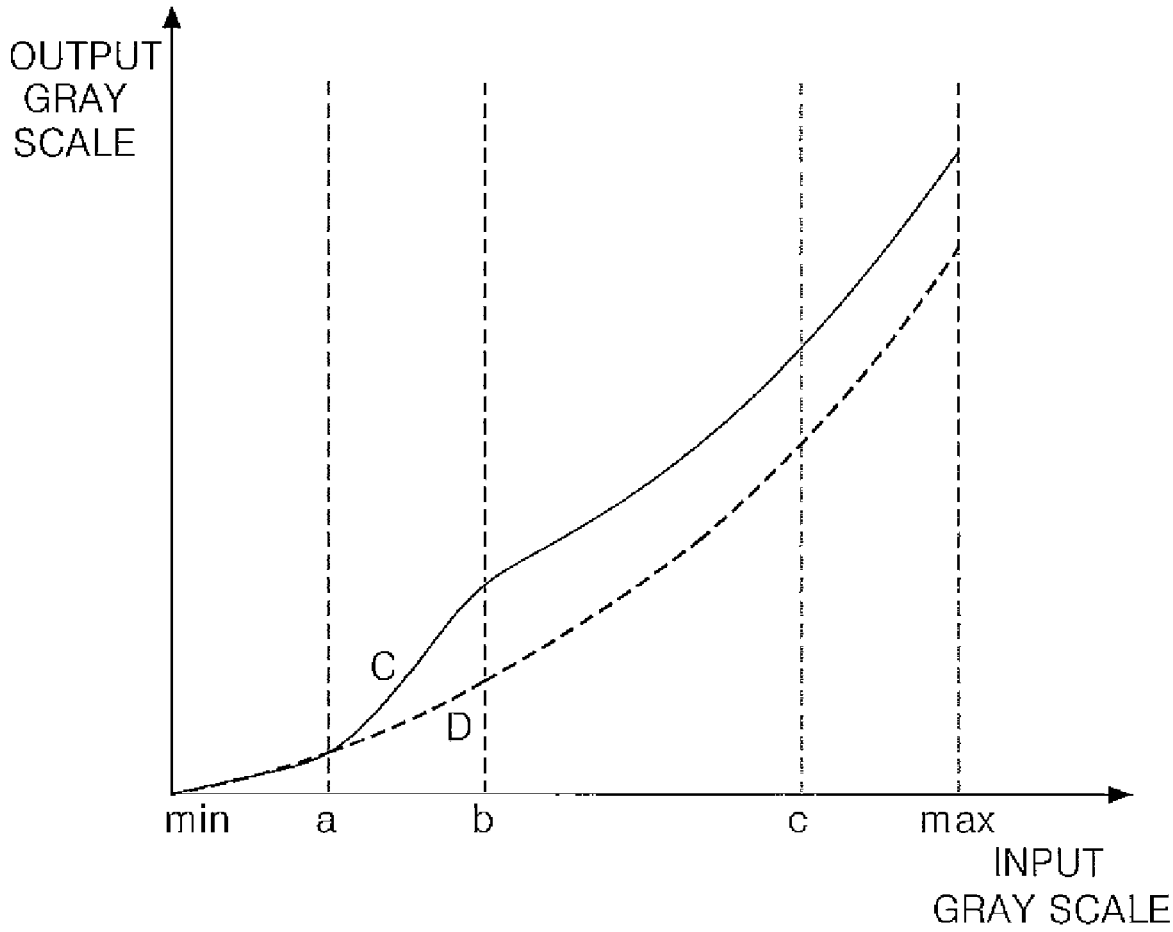
FIG. 11 is a diagram showing that a tilt of an output gamma curve is changed at a low gray scale range by modulating a low gray scale input data.

FIG. 9 is a diagram showing an example of a case that an input image is a dark image having low brightness, FIG. 10 is a diagram showing an accumulated density distribution of a pixel for each gray scale range regarding FIG. 9, and FIG. 11 is a diagram showing that a tilt of an output gamma curve is changed at a low gray scale range (a to b) by modulating a low gray scale input data.

A method of modulating a digital data of an input image at the low gray scale range (a to b) according to the embodiment of the present invention will be described with reference to FIG. 9 to FIG. 11 as follows. First, if a resolution of an OLED panel that an image of 256 gray scales is display by an input data having 8 bits is 100×100, and a histogram is divided into 4 number of gray scale areas, the number of whole pixel data of one screen is 10000. It assumes that the number of pixel data which are cumulated for each gray scale area of a histogram regarding one frame data of an image to be inputted to the OLED panel is the same as a graph in FIG. 10. An accumulated density distribution of a pixel for each gray scale range is high at the low gray scale range (a to b) as shown in FIG. 10 in the case where an input image is a dark image of low-level brightness as shown in FIG. 9. In other words, FIG. 10 shows that 1500 number of pixel data exist at the minimum gray scale (min to a) area, 1500 number of pixel data exist at the intermediate gray scale (b to c) area, 200 number of pixel data exist at the high gray scale (c to max) area, and 6800 number of pixel data exist at the low gray scale (a to b) area. Accordingly, The image analyzing part 240 judges that an accumulated density of a pixel regarding the low gray scale range (a to b) exceeds over the pre-set reference value X2. And The image analyzing part 240 supplies the data modulating control signal Cdm to the data modulating part 280 The reference value X2 is a value which is defined in the case where the cumulated pixel number at the low gray scale (a to b) area is further increased as much as a predetermined value k2 than a sum Y2 of the cumulated pixel number at the area (min to a and b to max) other than thereof. Herein, since the predetermined value k2 is changeable, the reference value X2 may be set as a few numbers depending upon a characteristics of the OLED panel.

The data modulating part 280 modulates an input digital data to heighten a tilt of an output gamma curve, so that it becomes possible to prevent a deterioration of a uniformity of an image at the low gray scale range at the low gray scale (a to b) area in response to the data modulating control signal Cdm as shown in FIG. 10. A tilt of an output gamma curve is determined between the pre-set maximum critical value C and the pre-set reference value D at the low gray scale (a to b) area. In other words, a tilt of an output gamma curve is determined to the maximum critical value C when an accumulated density of a pixel regarding the low gray scale range (a to b) is relatively the highest. A tilt of an output gamma curve is determined to the reference value D when an accumulated density of a pixel regarding the high gray scale range (c to max) is relatively the lowest. In this way, a plurality of look-up tables LUT are stored at the memory 260 in order to change a tilt of an output gamma curve. Herein, the plurality of look-up tables LUT lower an input versus output ratio at the low gray scale range (a to b) corresponding to a data of dark image property. On the other hand, output gamma curves of an area (min to a and b to max) other than the low gray scale range (a to b) are determined to the pre-set reference values.

As described above, the organic light emitting diode display and the driving method thereof according to the present invention modulate an input digital data in a high-level brightness image having data of a high gray scale range to decrease brightness of an image, thereby preventing a deterioration of a life span of an organic light emitting diode device, and a driving method thereof.

Furthermore, the organic light emitting diode display and the driving method thereof according to the present invention modulates an input digital data in a low brightness image having data of a low gray scale range to increase brightness of an image, thereby preventing a deterioration of a uniformity of an image at the low gray scale range.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving an organic light emitting diode display, comprising:

analyzing a digital data corresponding to an input image of a screen to analyze an accumulated density distribution for each gray scale range of the image which to be displayed on the screen;

modulating the digital data of the input image to lower a tilt of a gamma curve corresponding to a pre-set high gray scale range among gamma curves of the input image if data belonged to the high gray scale range is determined as a dominant of the digital data of the input image according to the analyzed result;

modulating the digital data of the input image to raise a tilt of a gamma curve corresponding to a specific gray scale range among gamma curves of the input image if data belonged to the specific gray scale range is determined as a dominant of the digital data of the input image as the analyzed result, wherein the specific gray scale range is set lower than the high gray scale range; and converting the modulated digital data of the input image into an analog signal, wherein an output gray value corresponding to max input gray is modulated to be lowered if data belonged to the high gray scale range is determined as a dominant of the digital data of the input image, wherein the tilt of the gamma curve corresponding to the pre-set high gray scale range is adjusted to a tilt that is lower than a reference tilt and higher than a tilt having a zero value if the data belonged to the high gray scale range is determined as the dominant of the digital data of the input image, and wherein a gamma curve of entire gray scale ranges corresponding to the digital data of the input image is determined depending upon the reference tilt which is differently set for each gray scale range.

2. The method of driving the organic light emitting diode display according to claim 1, wherein the tilt of the gamma curve corresponding to the high gray scale range is fixed to the reference tilt if data belonged to the high gray scale range is less than data belonged to the other gray scale ranges.

3. The method of driving the organic light emitting diode display according to claim 2, wherein the step of modulating the data, comprising, connecting gamma curves for each gray scale range each other so that an end point of a gamma curve of the previous gray scale range is connected to a start point of a gamma curve of a next gray scale range.

4. The method of driving the organic light emitting diode display according to claim 1, wherein the tilt of the gamma curve corresponding to the specific gray scale range is adjusted to a tilt higher than the reference tilt if data belonged to the specific gray scale range is determined as a dominant of the digital data of the input.

5. The method of driving the organic light emitting diode display according to claim 3, wherein the tilt of the gamma curve corresponding to the specific gray scale range is fixed to the reference tilt if data belonged to the specific gray scale range is less than data belonged to other gray scale ranges.

6. The method of driving the organic light emitting diode display according to claim 4, wherein the step of modulating the data, comprising, connecting gamma curves for each gray scale range each other so that an end point of a gamma curve of a previous gray scale range is connected to a start point of a gamma curve of a next gray scale range.

7. An organic light emitting diode display, comprising:

an organic light emitting diode display panel;

an image analyzer analyzing a digital data of an input image of a screen to analyze an accumulated density distribution for each gray scale range of an image to be displayed on the screen;

a data modulator modulating the digital data of the input image to lower a tilt of a gamma curve corresponding to a pre-set high gray scale range among gamma curves of the input image if data belonged to the high gray scale range is determined as a dominant of the digital data of the input data according to the analyzed result, and modulating the digital data of the input image to raise a tilt of a gamma curve corresponding to a specific gray scale range among gamma curves of the input image if data belonged to the specific gray scale range is determined as a dominant of the digital data of the input image according to the analyzed result, wherein the specific gray scale range is set lower than the high gray scale range; and a driver converting the modulated digital data into an analog signal and outputting the analog signal to the organic light emitting diode display panel, wherein an output gray value corresponding to max input gray is modulated to be lowered if data belonged to the high gray scale range is determined as a dominant of the digital data of the input image, wherein the tilt of the gamma curve corresponding to the pre-set high gray scale range is adjusted to a tilt that is lower than a reference tilt and higher than a tilt having a zero value if the data belonged to the high gray scale range is determined as the dominant of the digital data of the input image, and wherein a gamma curve of entire gray scale ranges corresponding to the digital data of the input image is determined depending upon the reference tilt which is differently set for each gray scale range.

8. The organic light emitting diode display according to claim 7, further includes:

a memory supplying an output digital data which is mapped to each input digital data of the high gray scale range and the specific gray scale range, respectively, to the data modulator in response to a data modulating control signal which is generated on the basis of the analyzed result of an accumulated density distribution for each gray scale range.

9. The organic light emitting diode display according to claim 8, wherein the memory includes:

a plurality of look-up tables increasing or decreasing an input versus an output ratio of the digital data.

10. The organic light emitting diode display according to claim 7, wherein the tilt of the gamma curve corresponding to the high gray scale range is fixed to the reference tilt if data belonged to the high gray scale range is less than data belonged to the other gray scale ranges.

11. The organic light emitting diode display according to claim 7, wherein the tilt of the gamma curve corresponding to the specific gray scale range is adjusted to a tilt higher than the reference tilt if data belonged to the specific gray scale range is determined as a dominant of the digital data of the input data.

12. The organic light emitting diode display according to claim 11, wherein the tilt of the gamma curve corresponding to the specific gray scale range is fixed to the reference tilt if data belonged to the specific gray scale range is less than data belonged to the other gray scale ranges.

* * * * *